US006434902B1

(12) United States Patent
Westra

(10) Patent No.: US 6,434,902 B1
(45) Date of Patent: Aug. 20, 2002

(54) POURED CONCRETE WALL INSULATION

(76) Inventor: Gregory A. Westra, 19548 Gunpowder Rd., Millers, MD (US) 21107

( * ) Notice: Subject to any disclaimer, the term of this patent is extended or adjusted under 35 U.S.C. 154(b) by 0 days.

(21) Appl. No.: 09/685,923

(22) Filed: Oct. 10, 2000

(51) Int. Cl.[7] ..... E04G 17/06; E04G 17/00

(52) U.S. Cl. ..... 52/309.17; 52/404.2; 52/506.05; 249/213; 249/40

(58) Field of Search ..... 52/309.17, 309.16, 52/309.15, 98, 404.2, 404.3, 404.5, 509, 513, 506.05, 300, 301; 249/40, 41, 45, 47, 213, 214, 216, 217, 218

(56) References Cited

U.S. PATENT DOCUMENTS

| | | | | | |
|---|---|---|---|---|---|
| 3,121,277 | A | * | 2/1964 | Dusselier et al. | 249/40 |
| 3,186,677 | A | * | 6/1965 | Dudley | 249/41 |
| 3,274,680 | A | * | 9/1966 | Cruse | 249/216 X |
| 3,378,975 | A | * | 4/1968 | Hill | 52/509 X |
| 3,690,613 | A | * | 9/1972 | Shoemaker | 249/40 |
| 3,742,670 | A | * | 7/1973 | Byrd, Jr. | 52/404.2 X |
| 3,829,150 | A | * | 8/1974 | Moore | 52/404.3 X |
| 3,985,329 | A | * | 10/1976 | Liedgens | 249/40 |
| 4,030,261 | A | * | 6/1977 | Coleman | 52/506.05 X |
| 4,576,532 | A | * | 3/1986 | Hanson et al. | 52/506.05 X |
| 4,936,540 | A | * | 6/1990 | Boeshart | 249/40 X |
| 5,600,927 | A | * | 2/1997 | Kennon | 52/301 |
| 5,651,910 | A | * | 7/1997 | Myers et al. | 249/41 |
| 5,895,188 | A | * | 4/1999 | Cheng | 249/40 X |
| 5,943,836 | A | * | 8/1999 | Kassardjian | 52/301 |
| 6,138,981 | A | * | 10/2000 | Keith et al. | 249/41 |
| 6,279,285 | B1 | * | 8/2001 | Kubica | 249/41 X |

FOREIGN PATENT DOCUMENTS

| | | | | |
|---|---|---|---|---|
| DE | 2703665 | * | 3/1978 | 52/404.2 |
| FR | 2232217 | * | 12/1974 | 249/213 |
| FR | 2250362 | * | 5/1975 | 249/40 |
| JP | 1-198971 | * | 8/1989 | 249/214 |

* cited by examiner

*Primary Examiner*—Laura A. Callo
(74) *Attorney, Agent, or Firm*—Bartlett & Sherer; Ronald B. Sherer

(57) ABSTRACT

A system is disclosed for securing insulation panels to the surface of a poured concrete wall by securing caps to the protruding ends of the ties extending through the wall.

16 Claims, 5 Drawing Sheets

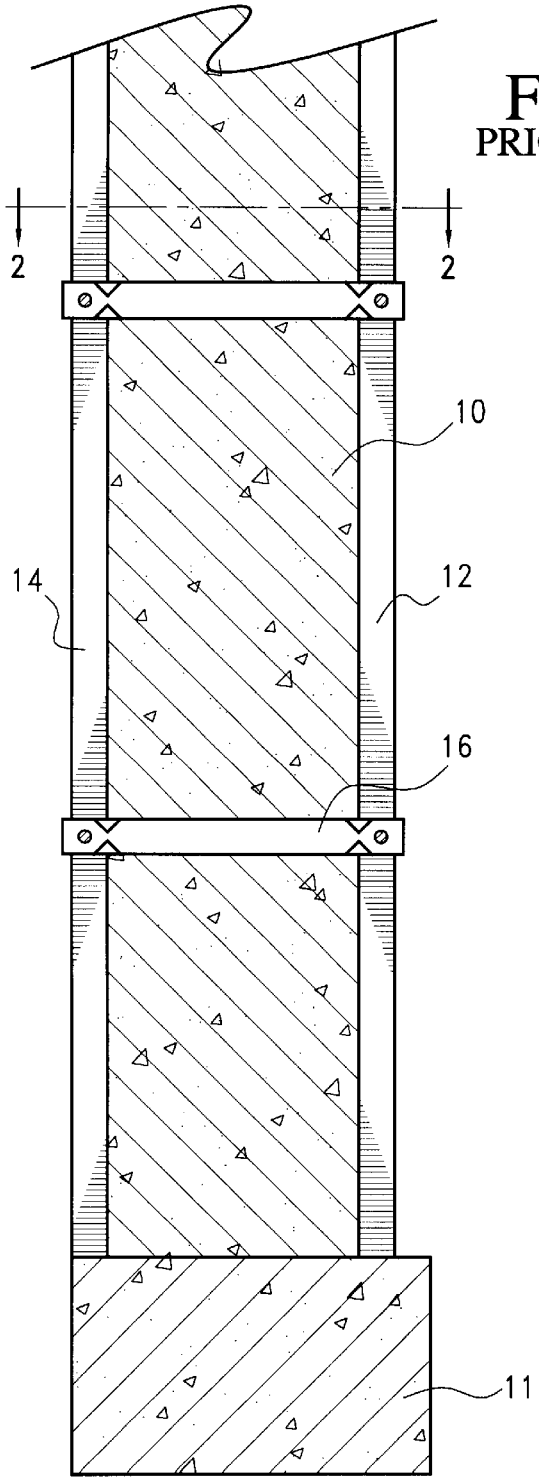
FIG.1
PRIOR ART
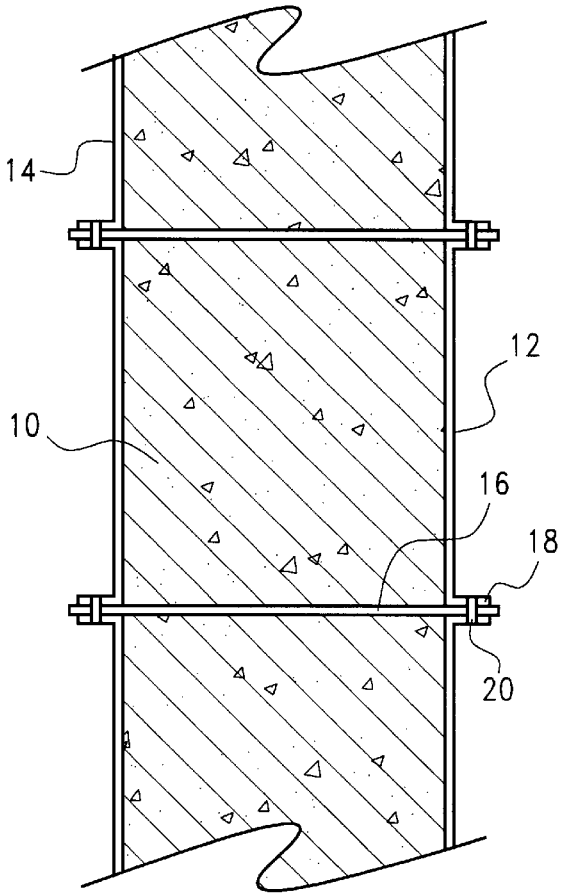
FIG.2
PRIOR ART
FIG.3
PRIOR ART
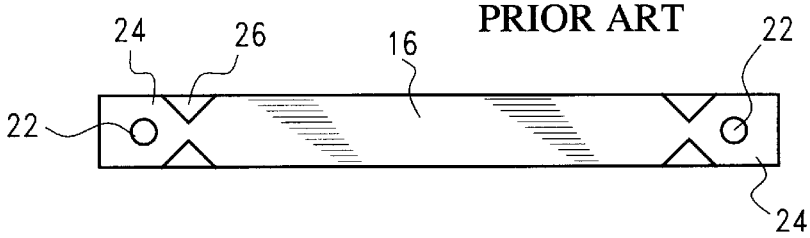

POURED CONCRETE WALL INSULATION

FIELD

This invention relates to insulatino concrete walls, and more particularly, to a system for attaching layers of insulation to the inner and/or exterior surfaces of poured concrete walls using conventional wall ties.

BACKGROUND

Until very recently, the conventional method of attaching layers of insulation materials to a poured concrete wall was to frame the wall with wood or plastic framing strips; the framing strips begin secured to the wall by concrete nails or the equivalent. This procedure is labor intensive, time consuming and therefore quite costly.

More recently, a system know under the trademark THERMAEZE has been introduced. This system is described in Ser. No. 065,285, now U.S. Pat. No. 6,079,176. This system allows the insulation layers to be held in place while the concrete wall is poured which substantially reduces the labor and cost of an insulated wall. However, this system requires the installation of a large number of web connectors and wedges before the wall can be poured.

SUMMARY

The present invention solves all of the above-indicated long-standing problems by using the standard wall ties, which are conventionally used to hold the wall frames in place, and easy to install caps. This system is installed after the pouring and setting of the wall and eliminates the labor of removing the ends of the conventional ties which is a large saving of labor and cost.

BRIEF DESCRIPTION OF DRAWINGS

FIG. 1 is an elevational view, partly in cross-section of a concrete wall poured between a pair of standard, spaced apart wall forms which are secured by standard, horizontally extending ties;

FIG. 2 is a cross-sectional view of the poured concrete wall taken along view line 2—2 showing the connection of the wall forms to the horizontally extending ties;

FIG. 3 is an elevational side view of a conventional wall tie used to secure the wall forms;

FIG. 8-A is an enlarged top view of another embodiment of a cap locked on the end of a tie;

DETAILED DESCRIPTION

Figure 4:
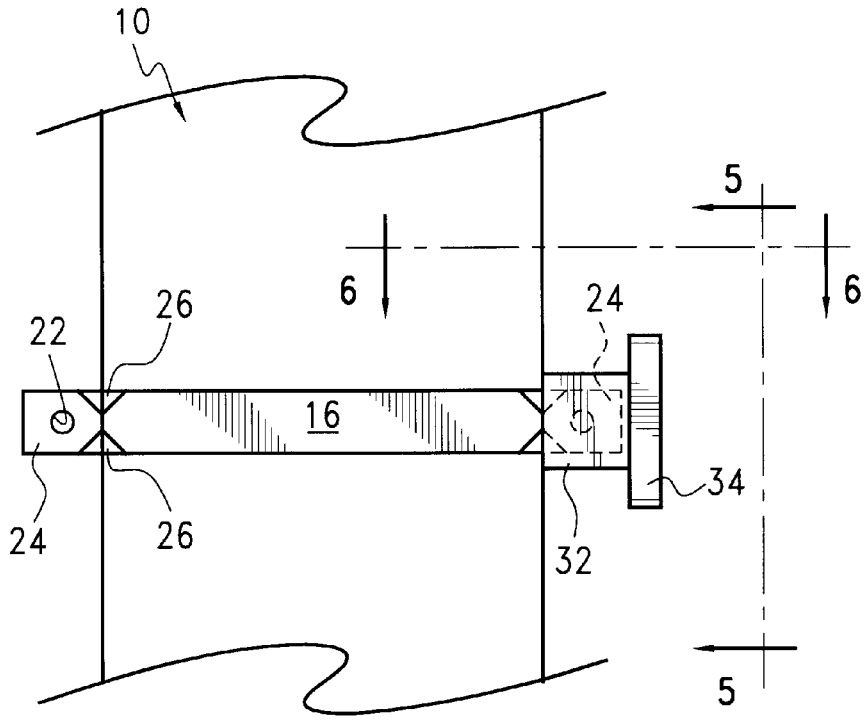
FIG. 4 is an elevational view, partly in cross-section, of the poured concrete wall and one tie after the wall forms have been removed, and one cap has been installed.

Referring first to FIG. 1, a poured concrete wall 10 on a footer 11 is shown as having been poured between standard wall forms 12 and 14. Wall forms 12 and 14 may be of metal, wood or plastic and are held in their horizontally-spaced, vertical position by conventional wall ties 16 which are well-known in the construction industry. Wall forms 12, 14 are further shown in FIG. 2 as having flanges 18 which are secured to ties 16 by connectors 20 passing through holes 22 in the ends of the ties. It will be understood to those skilled in the art of pouring concrete walls that connectors 20 are designed to be removable after the pouring and setting of the wall. As such, they may be in the form of removable wedges, bolts or other removable connectors passing through flanges 18 and holes 22.

FIG. 3 illustrates one conventional form of wall tie 16. It comprises a strip of metal of sufficient length to extend through the depth of the wall with ends 24 extending beyond the inner and outer wall surfaces of the wall. Thus, when connectors 20 are removed after the wall has been poured and set, wall forms 12 and 14 are removed, and ties 16 remain imbedded in the wall with ends 24 extending outwardly from the interior and exterior surfaces of the wall as illustrated in FIG. 4. In addition to holes 22, conventional wall ties 16 include grooves or notches 26. These notches are provided for the ex- purpose of breaking off ends 24 after the concrete has set so as not to protrude beyond the interior or exterior surfaces of poured concrete wall 10. Typically, a hammer is used to break-off ends 24 of each tie and this labor intensive.

Instead of breaking off all of ends 24 of ties 16, the present invention utilizes one or both of the ends 24 of the ties for securing an interior and/or exterior layer of insulation as may be desired in that particular application. That is, for interior insulation in below grade constructions, and for interior and/or exterior insulation in above ground constructions.

Figure 5:
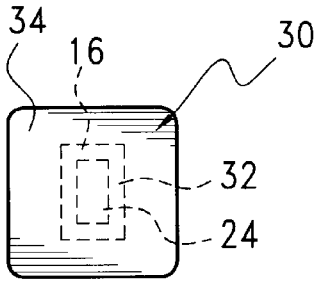
FIG. 5 is an elevational view of the cap taken along view line 5—5 of FIG. 4.
Figure 6:
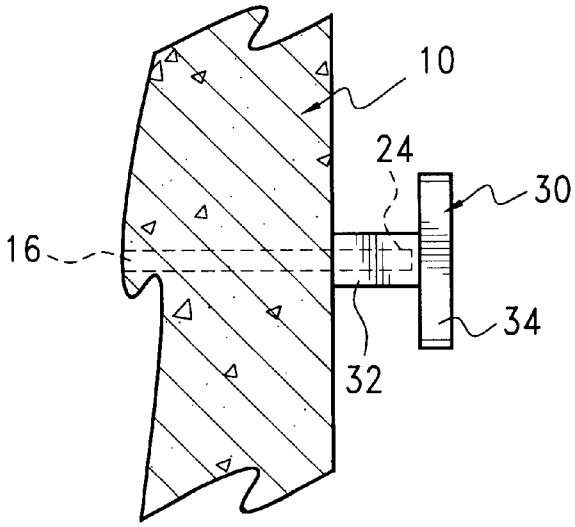
FIG. 6 is a top view taken along view line 6—6 of FIG. 4.
Figure 7:
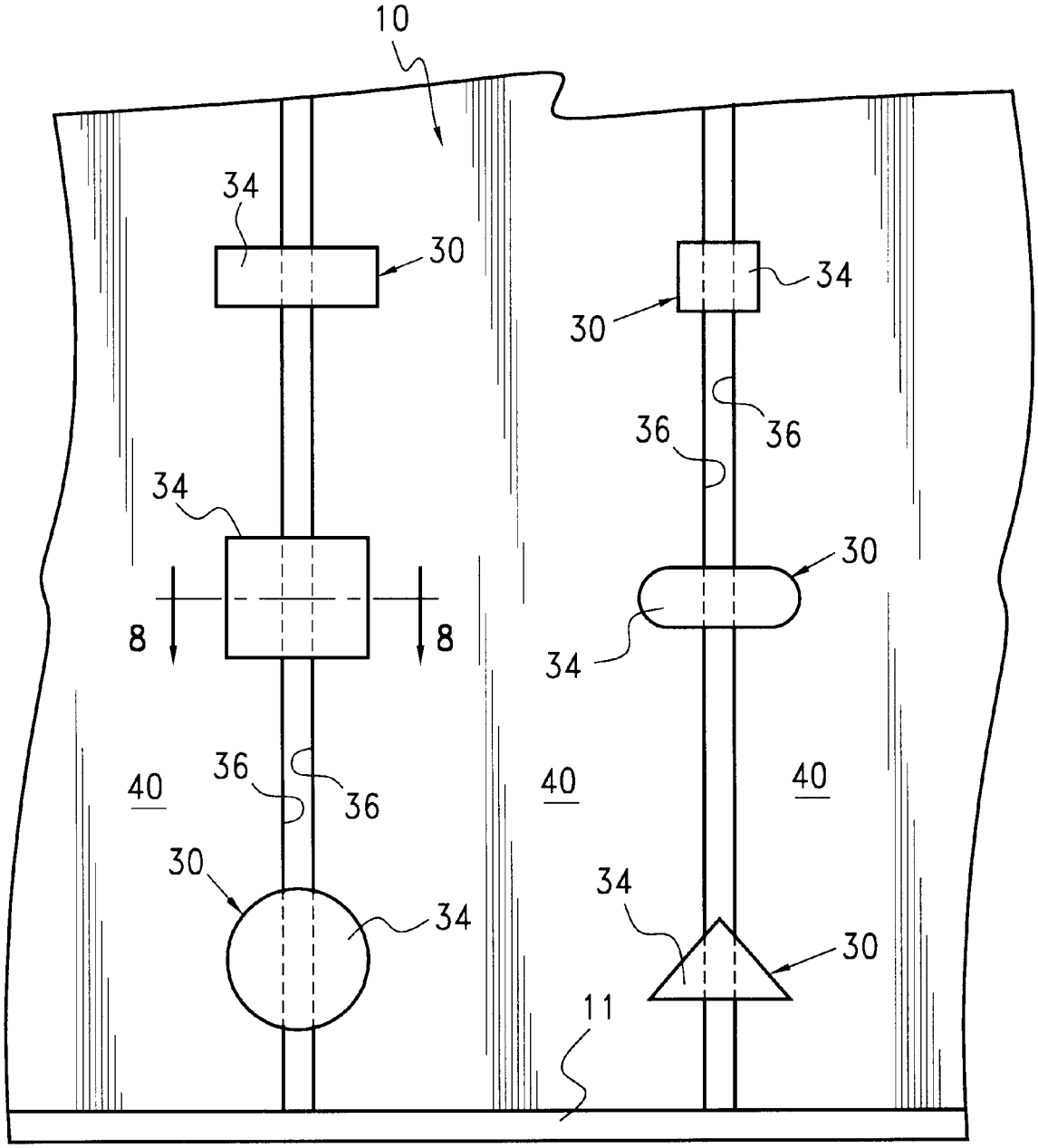
FIG. 7 is an elevational view of multiple insulation panels secured by various shaped caps positioned on the ends of wall ties.

As illustrated in FIGS. 4, 5 and 6, the present invention utilizes clips or caps 30 which fit over the ends 24 of ties 16 and are secured on the ties by various means to be described hereafter. One embodiment of such a clip or cap 30, hereinafter a "cap", is shown in FIGS. 4, 5 and 6 as comprising an element having a hollow body 32 and enlarged flange 34; caps 30 being preferably composed of molded plastic. It will be understood that although flanges 34 are shown in FIG. 5 as being square, flanges 34 may be of rectangular, circular, or other shape as illustrated in FIG. 7. The only requirement of the shape of flanges 34 is that they be large enough to overlie the edges 36 of the insulation panels 40 as shown in FIG. 7. Of course, it will be understood that caps 30 are inserted over the ends of 24 of the ties by being pushed and/or hammered onto the ends.

Figure 8:
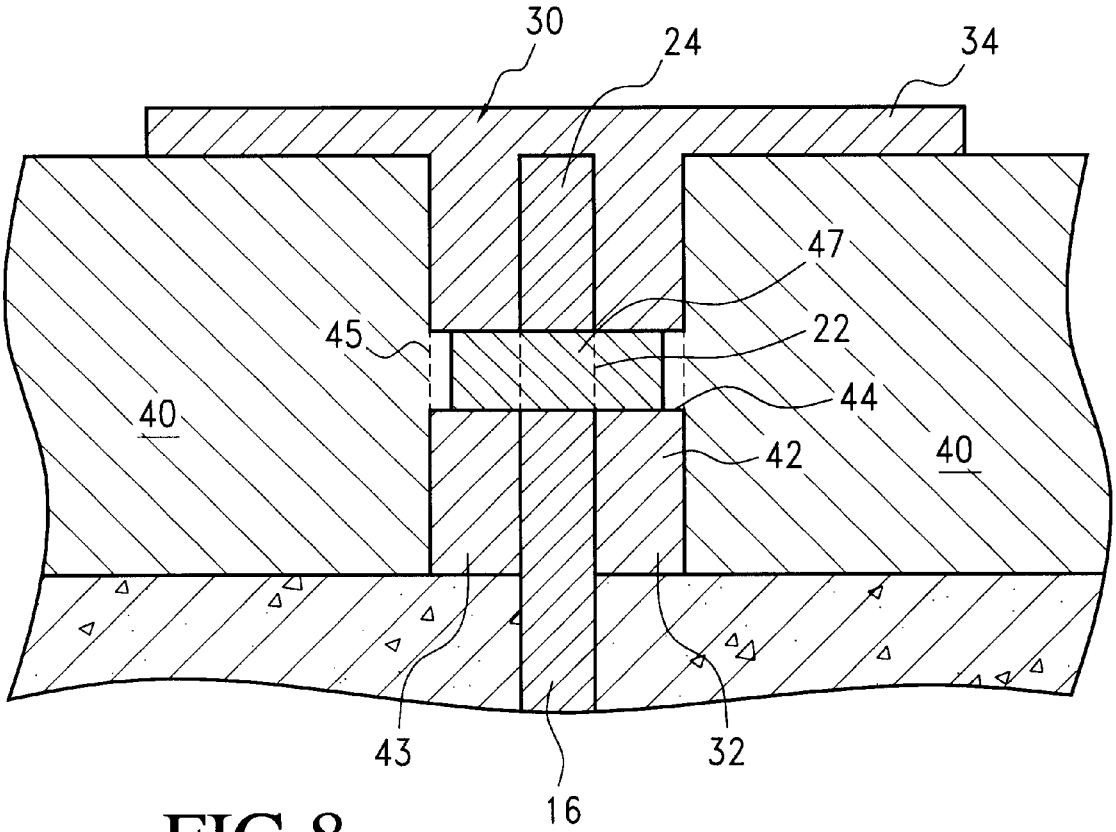
FIG. 8 is a top view of one cap locked on one tie end taken along view line 8—8 of FIG. 7.

FIG. 7 schematically illustrates a plurality of caps 30 securing multiple panels of insulation 40 in place against a concrete wall. The method of attaching insulation panels 40 to the wall is extremely simple and fast. In the first method, two vertical rows of caps are secured to ends 24 of two rows of ties 16, by frictional engagement or means to be described hereafter. Then, the edges 36 of a panel 40 is simply slid between the surface of concrete wall 10 and flanges 34 as shown in FIGS. 7 and 8. Alternatively, only one vertical row of caps 30 may be installed on a vertical row of the ends of ties 16, and one panel 40 may then be placed with one vertical edge 36 of the panel between the wall and the flanges of caps 30. Thereafter, a second vertical row of caps may be installed such that the second vertical edge 36 of the panel is secured by the second row of caps, and a second panel may be positioned as just described with respect to the first panel.

In either mode, ties 16 have already been secured in the poured concrete wall in order to hold the wall forms such that no additional effort or cost is required for their presence in the wall with their ends protruding outwardly therefrom. Moreover, the time and effort required to knock off, or otherwise remove, ends 24 is generally equal to or greater than the time required to position caps 30 on the ends of the ties. Accordingly, the time and effort of the installation process is substantially no greater than that required for a non-insulated wall with ends 24 of the ties removed.

With respect to the details of how caps 30 are secured to ends 24 of ties 16, several embodiments have been discovered. First, as shown most clearly in FIGS. 4, 5 and 6, the interior dimensions of bodies 32 of caps 30 may be sized slightly smaller than the external dimensions of the ends of the ties. Thus, caps 30 may be forced, such as by one or two blows of a hammer against the center of flange 34, so as to drive the caps onto the ends of the ties. This produces a substantial frictional force preventing the caps from moving off of tie ends 24. In this regard, it will be noted that the entire weight of panels 40 is entirely vertical, and very little if any force is exerted against flanges 34 such as to urge the caps off of ties ends 24. By way of example, if caps 30 are molded of plastic, and the internal dimensions of body 32 are in the order of a few hundredths (or thousandths?) of an inch smaller than that of ends 24, either in terms of the thickness or width of tie ends 24, caps 30 will be securely fastened by frictional engagement with tie ends 24, and will secure the insulation in place.

In addition to, or in place of, providing a strong frictional engagement of caps 30 on ties 16, positive locking means have also been discovered. One embodiment of such locking means is illustrated in FIG. 8 wherein walls 42 and 43 of body 32 are provided with holes 44 and 45 which are aligned with hole 22 in the tie when the cap is in place. Thus, a locking pin 47 may be inserted, and preferably driven into, body 32 and hole 22 of the tie. For example, holes 44 and 45 are preferably made slightly smaller than the diameters of pin 47 and hole 22. Therefor, once the pin is forced through holes 44 and 45, the cap is positively secured against any movement away from wall 10.

FIG. 8-A illustrates a variation of the FIG. 8 embodiment in which one of holes 44 or 45 is a blind hole, such as hole 45' as illustrated. Accordingly, locking pin 47 may be driven through holes 44 and 22, and only part way through blind hole 45'. Blind hole 45' stops the pin from being inserted further while insuring that the other end of pin 47 is countersunk, or at least flush, with the exterior surface of wall 42 of body 32.

FIG. 8-A further illustrates that a hole 41 of reduced size may be provided. Hole 41 enables the insertion of a nail, small pin or other element to force locking pin 47 out of holes 22 and 44 in the event that, for any reason, it is desired to remove one or more of caps 30.

Figure 8A:
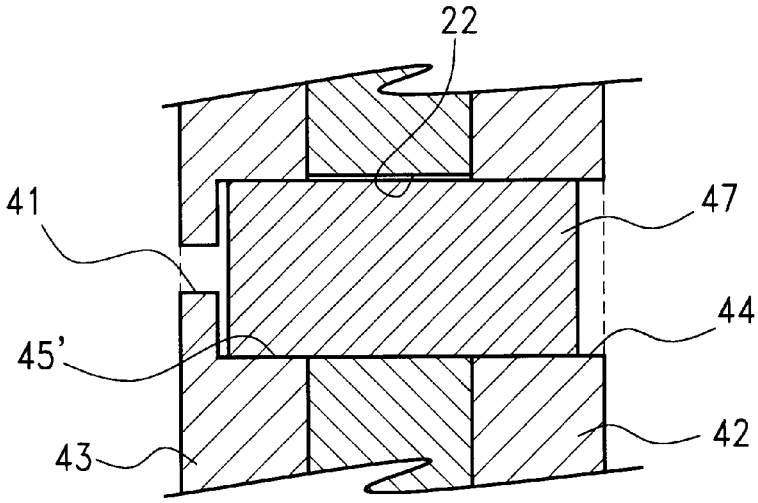
Figure 9:
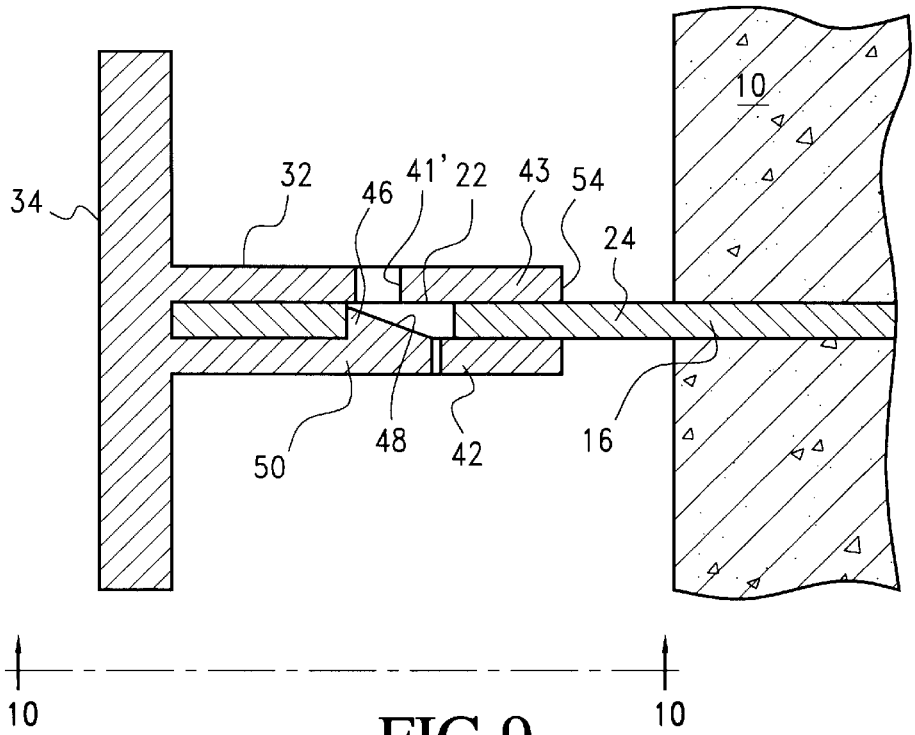
FIG. 9 is a top view taken along view line 8—8 illustrating a further embodiment of a cap locked on the end of a tie.
Figure 10:
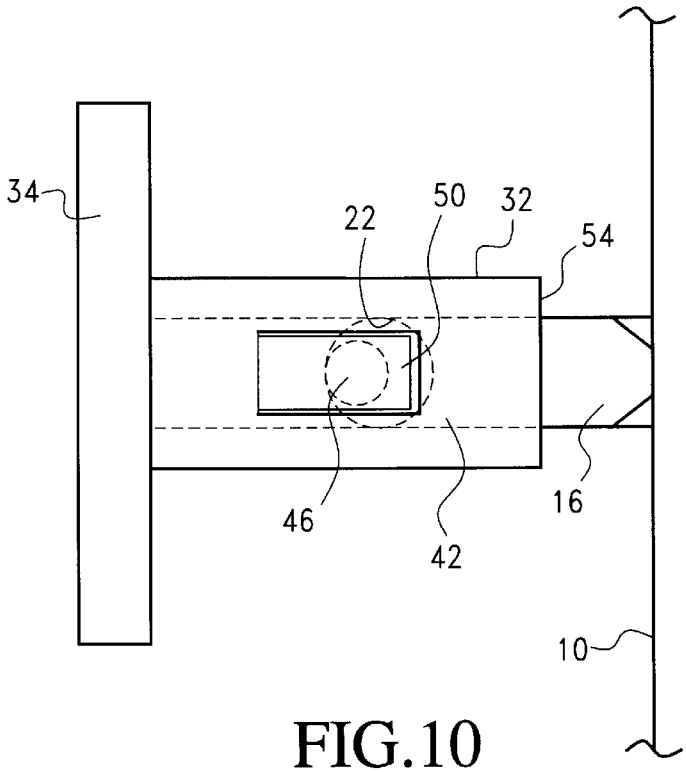
FIG. 10 is a side elevational view taken along view line 10—10 of FIG. 9.

A further preferred embodiment is illustrated in FIGS. 9 and 10. In this embodiment, one of the walls of body 32, such as wall 42 for example, has a cut-out portion so as to form a flexible strip or finger 50. Flexible strip or finger 50 includes a projection 46 on the inner surface of the flexible finger, and projection 46 preferably includes a ramp or cam surface 48. Thus, when cap 30 is inserted onto end 24 of tie 16, cam surface 48 engages the side surface of the tie, and finger 50 is flexed outwardly; i.e., away from the tie, until projection 46 aligns wish hole 22 in the tie. At this point, as shown in FIG. 9, projection 46 snaps into hole 22 and positively locks the cap in place. However, a pin may be pushed through hole 41' to unlock projection 46 as previously described with reference to FIG. 8A. Of course, instead of finger 50 extending only part way along the axial length of body 32 as illustrated, body 32 may be cut or molded such that flexible finger 50 extends to end 54 of body 32. Also, it will be noted in FIGS. 9 and 10 that the axial length of body 32 extending along the horizontal surface of the tie need not necessarily be such as to contact wall 10. This is because it has been discovered in the locking embodiments, that the axial length of body 32 may be significantly less than the distance between wall 10 and flange 34 while still being positively secured. Therefore, body 32 may be substantially shorter than the thickness of the insulation panel 40, thereby substantially reducing the amount of plastic required for each of caps 32 and the associated cost.

From the foregoing description of several preferred embodiments, it will be apparent that other variations of the invention will become obvious to those skilled in the art of poured concrete walls. Therefore, it is to be understood that the foregoing description is intended to be solely illustrative of the principles of the invention, and that the true invention is not intended to be limited other than by as expressly set forth in the following claims interpreted under the doctrine of equivalents.

What is claimed is:

1. In combination:

(a) a poured concrete wall having inside and outside surfaces;

(b) a layer of insulation in engagement with at least one of said concrete wall surfaces;

(c) a plurality of ties extending through said poured concrete wall and having end portions protruding from said at least one of said concrete wall surfaces;

(d) a plurality of caps mounted on said protruding end portions of said ties;

(e) said caps having body portions and enlarged flange portions;

(f) said enlarged flange portions engaging and holding said insulation layer in engagement with said at least one of said concrete wall surfaces; and (g) means for securing said body portions of said caps on said end portions of said ties.

2. The system of claim 1 wherein said means for securing said body portions of said caps on said end portions of said ties comprise frictional contact between said caps and said end portions of said ties.

3. The system of claim 1 wherein said means for securing said body portions of said caps on said end portions of said ties comprise holes in said end portions, and means connecting said caps to said holes.

4. The system of claim 3 wherein said means for securing said caps on said end portions of said ties comprise projecting means on said caps for protruding into said holes.

5. The system of claim 3 wherein said means for securing said caps on said end portions of said ties comprise pins extending through said holes in said tie ends.

6. The system of claim 3 wherein said means for securing said caps on said end portions of said ties comprise flexible portions on said caps and projections on said flexible portions for engaging into said holes.

7. The system of claim 6 wherein said caps have first and second walls extending parallel to said ties, and wherein said flexible portions comprise portions of one of said walls.

8. The system of claim 1 wherein the size and shape of said enlarged flange portions are such as to extend over portions of two of said insulation layers.

9. In a system for securing insulation against at least one surface of a concrete wall having ties extending therethrough with protruding ends of the ties and holes in the protruding ends of the ties, the invention comprising:

(a) cap means for mounting on the tie ends for securing the insulation against the wall.

10. The cap means of claim 9 wherein said cap means comprise a body portion and an enlarged flange portion, and wherein said body portion is of a size and shape such as to receive the end of a tie, and said flange portion is of a size and shape such as to engage and overlap the insulation.

11. The cap means of claim 10 wherein said body portion is of a size and shape such as to frictionally hold said body portion on the end of the tie.

12. The cap means of claim 10 wherein said body portion includes a hole of a size and shape such as to align with the hole in the tie end.

13. The cap means of claim 12 including a pin, said pin being of a size and shape such as to pass through the hole in said body portion of said cap means and the hole in the tie end.

14. The cap means of claim 13 wherein said body portion includes an aperture for inserting means for removing said pin.

15. The cap means of claim 10 wherein said body portion includes a flexible portion; and said flexible portion includes a projection of a size and shape such a to engage the hole in the end of the tie.

16. The cap means of claim 15 wherein said body portion includes an aperture for inserting means for moving said projection out of the hole in the end of the tie strip.

* * * * *